US009974373B2

(12) United States Patent
Pötscher

(10) Patent No.: US 9,974,373 B2
(45) Date of Patent: May 22, 2018

(54) EPILATOR HAVING A DRIVABLE MASSAGING MEMBER

(75) Inventor: Erich Pötscher, Ferndorf (AT)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 243 days.

(21) Appl. No.: 12/995,690

(22) PCT Filed: Jun. 8, 2009

(86) PCT No.: PCT/IB2009/052416
§ 371 (c)(1),
(2), (4) Date: Dec. 2, 2010

(87) PCT Pub. No.: WO2009/150599
PCT Pub. Date: Dec. 17, 2009

(65) Prior Publication Data
US 2011/0082470 A1 Apr. 7, 2011

(30) Foreign Application Priority Data
Jun. 13, 2008 (EP) ..... 08158236

(51) Int. Cl.
*A61B 17/50* (2006.01)
*A45D 26/00* (2006.01)

(52) U.S. Cl.
CPC ..... *A45D 26/0061* (2013.01); *A45D 26/0028* (2013.01)

(58) Field of Classification Search
CPC ..... A45D 26/0023; A45D 26/0028; A45D 26/0061
USPC ..... 606/133, 131; 601/46, 52
See application file for complete search history.

(56) References Cited

U.S. PATENT DOCUMENTS 2,880,503 A 4/1959 Carissimi
5,190,559 A 3/1993 Gabion et al.
5,312,419 A * 5/1994 Garenfeld ..... A22C 21/028 606/131
5,810,843 A 9/1998 Iwasaki et al.
5,893,854 A * 4/1999 Bontoux ..... A45D 26/0061 606/131
5,976,157 A 11/1999 Yiu
6,004,331 A * 12/1999 Takeuchi et al. ..... 606/133
(Continued)

FOREIGN PATENT DOCUMENTS

DE 102005061539 A1 7/2007
EP 0760219 A1 3/1997
(Continued)

*Primary Examiner* — Gregory Anderson
*Assistant Examiner* — Sarah Simpson

(57) ABSTRACT

The invention relates to an epilator (10) comprising an epilation head (18) having at least one rotatable disc-shaped member (20), a massaging member (34) arranged next to the epilation head, and a drive structure for driving the massaging member (34). According to the invention, the drive structure comprises a cylinder (26) for contacting a circumference of said at least one disc-shaped member (20) for the purpose of being rotated by said at least one disc-shaped member (20) about a rotational axis (30), wherein the cylinder (26) has a contact surface which is symmetrical about the rotational axis (30). The drive structure may further comprise an eccentric tappet (32) arranged for being rotated by the cylinder (26).

11 Claims, 8 Drawing Sheets

(56) References Cited

U.S. PATENT DOCUMENTS

| | | | | |
|---|---|---|---|---|
| 6,123,713 | A | 9/2000 | Yiu et al. | |
| 6,520,970 | B1 * | 2/2003 | Sanchez-Martinez | 606/133 |
| 6,740,097 | B1 * | 5/2004 | Sanchez-Martinez | 606/133 |
| 7,211,090 | B2 * | 5/2007 | Kreutz et al. | 606/133 |
| 7,686,156 | B2 * | 3/2010 | Tabler | 198/465.4 |
| 8,936,865 | B2 | 1/2015 | Kim | |
| 2005/0143755 | A1 | 6/2005 | Hashiguchi et al. | |
| 2007/0093853 | A1 * | 4/2007 | Poran | 606/133 |
| 2011/0054491 | A1 * | 3/2011 | Sanchez-Martinez et al. | 606/133 |

FOREIGN PATENT DOCUMENTS

| | | | |
|---|---|---|---|
| EP | 1300095 | B1 | 4/2003 |
| JP | 2000201725 | A | 7/2000 |
| JP | 2009121930 | A | 6/2009 |
| WO | 0200058 | A1 | 1/2002 |
| WO | 02056724 | A1 | 7/2002 |
| WO | 03013334 | A2 | 2/2003 |
| WO | 2006035363 | A1 | 4/2006 |
| WO | 2007079885 | A1 | 7/2007 |

* cited by examiner

Section B - B

Section A - A

EPILATOR HAVING A DRIVABLE MASSAGING MEMBER

FIELD OF THE INVENTION

The invention relates to an epilator comprising an epilation head having at least one rotatable disc-shaped member, a massaging member arranged next to the epilation head, and a drive structure for driving the massaging member.

BACKGROUND OF THE INVENTION

Hand-held, motor-driven epilators have become increasingly popular in recent years. Such epilators generally comprise pairs of cooperating clamping discs or other mechanisms for extracting hairs from skin.

Epilation can be quite a painful procedure. However, it has been found that the pain can be significantly reduced by stimulating nerves in the skin immediately before, during or immediately after the extraction of hairs from the skin. Today, a multiplicity of epilators having a massage, vibration or other pain-reducing device are available. Such devices can be passive, or they can be actively driven by a motor, e.g. by the motor which also drives the clamping discs. In the latter case, separate drive trains or motion converters are usually employed for driving the clamping discs and for driving the pain-reducing device. However, separate drive trains and motion converters take up extra space, which may inhibit particularly compact and appealing designs.

U.S. Pat. No. 6,123,713 describes an epilator having a hair plucking assembly and a vibrating assembly adjacent to the hair plucking assembly, wherein an eccentric cylinder is mounted to a drive gear. The eccentric cylinder has an axis of rotation that is off-set from its geometric centre such that rotation of the drive gear lifts and lowers the vibrating head relative to the axis of rotation.

It is an object of the invention to provide an epilator having a pain-reducing element that is drivable by a particularly compact driving mechanism. This object is achieved by the characteristic feature of the independent claim. Further specifications and specific embodiments are outlined in the dependent claims.

SUMMARY OF THE INVENTION

According to the invention, the drive structure for driving the massaging member of the epilator comprises a cylinder for contacting a circumference of said at least one disc-shaped member for the purpose of being rotated by said at least one disc-shaped member about a rotational axis, wherein the cylinder has a contact surface which is symmetrical about the rotational axis. During operation of the device, the massaging member is thus driven by the at least one disc-shaped member, which in an example of the invention may be one or more clamping discs of the rotatable epilating head. Thus, the cylinder serves as an intermediate driving member for transmitting mechanical power from the rotating epilation head to the massaging member. As the massaging member is arranged next to the epilation head, the proposed mechanism can be particularly compact. Since the cylinder's contact surface is symmetrical about the rotational axis, a uniform rotation of the cylinder is ensured when the epilation head is rotated uniformly, that is, at a constant angular velocity and the rotational axis remaining immobile relative to the epilation head.

The drive structure may further comprise an eccentric tappet arranged for being rotated by the cylinder. The cylinder's uniform rotational motion may thus be converted into a translational or other type of motion. The tappet's cross section perpendicular to its rotational axis may be shaped so as to achieve a simple, double, or triple stroke mechanism, such that the tappet translates a member contacting the tappet once, twice, or three times per revolution of the tappet, respectively. The tappet's cross section may in particular define an ellipse or a Reuleaux triangle.

The cylinder and the eccentric tappet may be rigidly coupled to each other. In particular a base side of the cylinder may contact a base side of the tappet, the cylinder's base side and the tappet's base side being parallel to each other. More particularly, the cylinder and the eccentric tappet may form a single piece. The single piece thus has a first circumference, provided by the cylinder, and a different, eccentric second circumference provided by the tappet. Thereby, a particularly simple and robust coupling between the cylinder and the tappet is achieved.

The drive structure may further comprise a translational member arranged for being translated by the eccentric tappet. The cylinder's rotational motion may thereby be converted into an up and down movement of the translational member relative to the epilation head.

The epilator may further comprise a carrier rigidly coupled to the translational member and carrying the massaging member. Thus, the translational member's motion is directly transferred to the massaging member, without any intermediate movable members arranged between the translational member and the massaging member.

The epilator may comprise a rail for guiding the carrier. The rail thus restricts the carrier and hence the massaging member, allowing them to move in the directions defined by the rail.

The contact surface of the cylinder may be made of a slip-resistant material. The slip-resistant material may for example comprise rubber or a rubber-like material. Thereby it may be ensured that during operation of the device the cylinder rotates together with the clamping discs and that a maximum amount of force may be exerted onto the cylinder by the clamping discs. This may also lead to a reduction in noise.

The cylinder may be biased towards the at least one disc-shaped member by means of a spring. Thereby a firm contact between the at least one disc-shaped member and the cylinder is ensured.

The translational member may be biased towards the eccentric tappet by means of a spring. Thus it is ensured that the translational member remains in firm mechanical contact with the eccentric tappet.

The spring may comprise an elastic rod or an elastic leaf running along the rotational axis of the cylinder. Hence, as the spring is deformed in a direction perpendicular to the rotational axis, it will exert a force in the opposite direction, that force biasing the translational member toward the eccentric tappet or biasing the cylinder toward the clamping discs.

The massaging member may comprise a massage roller. A massage roller is understood to be a rotatable member that rolls on the skin as the epilator is displaced on the skin.

The massaging member and the drive structure including the cylinder may be part of an attachment which is attachable to and detachable from a housing of the epilator. The attachment may for example be designed to be fitted to existing epilators, in particular to epilators having no pain-reducing device. As a result of the fact that the cylinder is in relatively simple mechanical engagement with the epilation head, attaching the attachment to the housing or detaching the attachment from the housing is not hindered by mechanical engagement forces between the cylinder and the epilation head.

The attachment may comprise an outer cap surrounding a portion of the epilation head. The attachment thus prevents a portion of the epilation head from contacting the skin, for example, for preventing discomfort or injury.

These and other features of the invention will become apparent from the following description and the accompanying drawings.

DESCRIPTION OF PREFERRED EMBODIMENTS

Figure 1:
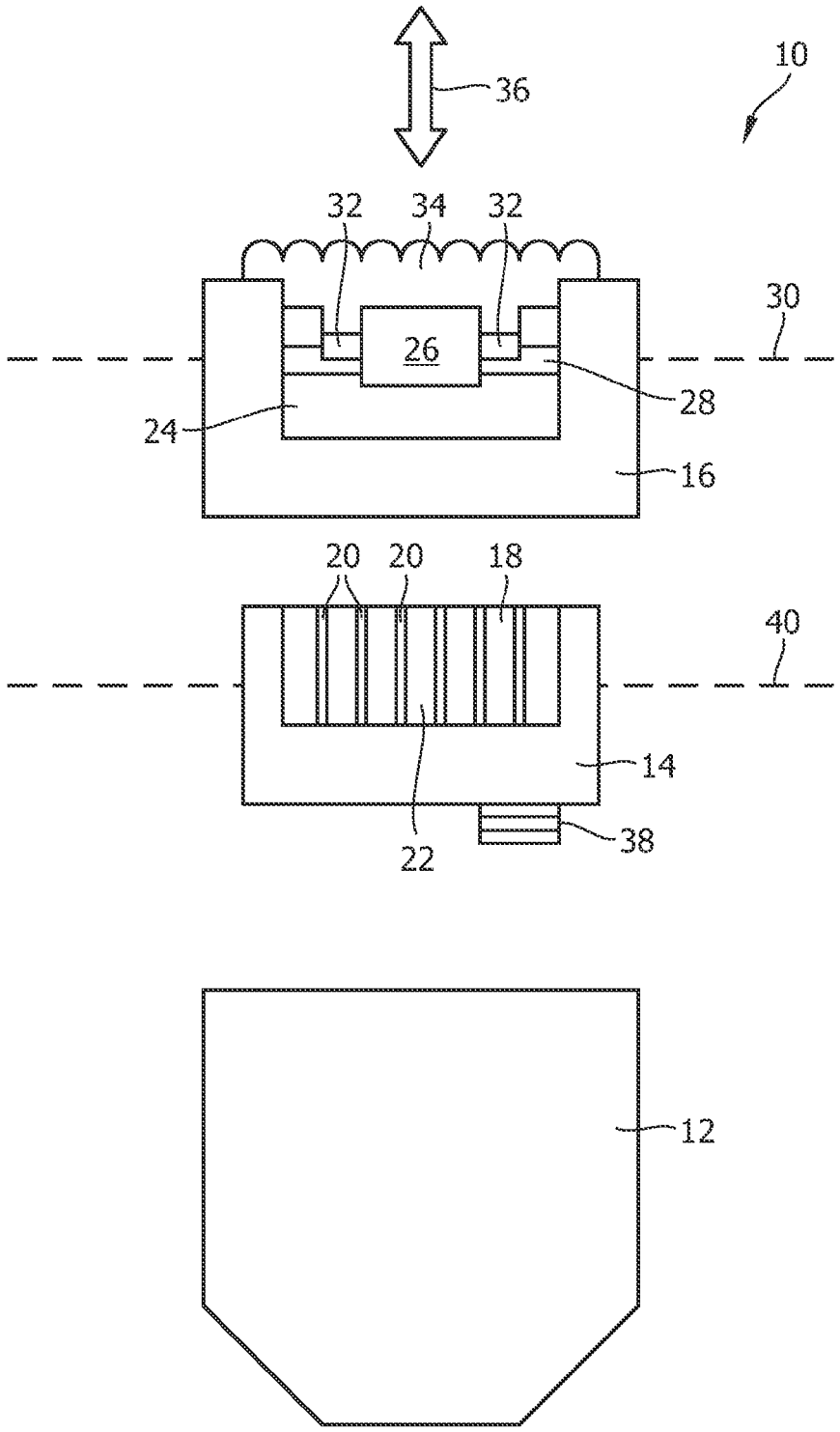
FIG. 1 shows a simplified partially exploded front view of an epilator.

Identical reference numerals in different Figures are used to designate identical, similar or analogous components. Such components are not necessarily described more than once.

FIG. 1 shows a simplified partially exploded side view of an epilator 10 comprising a housing 12, an epilation head 18, and a massaging member 34 for massaging skin during an epilation session. The epilation head 18 comprises several clamping discs 20 mounted rotatably about a rotational axis 40. The epilation head 18 is mounted to an inner cap 14 having means (not shown) for engaging with complementary means (not shown) of the housing 12, for fastening the inner cap 14 to the housing 12. Mechanically coupled to the clamping discs 20 is a gear wheel 38 which is intended for being driven by an electric motor (not shown) situated within the housing 12. The massaging member 34 is mounted to an outer cap 16 having means (not shown) enabling the cap to be attached to the housing 12. In an assembled state of the epilator 10, the outer cap 16 surrounds the inner cap 14 and defines a treatment window 24 through which the epilation head 18 may contact the skin. Also mounted to the outer cap 16 is a cylinder 26 for contacting the clamping discs 20 when the epilator 10 is in an assembled state. The cylinder 26 is substantially symmetrical under rotation about the rotational axis 30. Its cross section perpendicular to the rotational axis 30 thus defines a circle centered about the rotational axis 30. Formed in a single, essentially rigid, piece with the cylinder 26 is an eccentric tappet 32 contacting the massaging member 34. The single piece comprising the cylinder 26 and the eccentric tappet 32 can be made of metal, or plastic, or a combination of both, or of any other suitable material. The cross section of the eccentric tappet 32 perpendicular to the rotational axis 30 defines a Reuleaux triangle. As the cylinder 26 rotates about the rotational axis 30, and with it rotates the eccentric tappet 32, the tappet 32, due to its eccentricity, generates an up and down movement 36 of the massaging member 34 relative to the outer cap 16. The cylinder 26 is mounted to the outer cap 16 by means of an axle 28 running parallel to the rotational axis 30.

Figure 2:
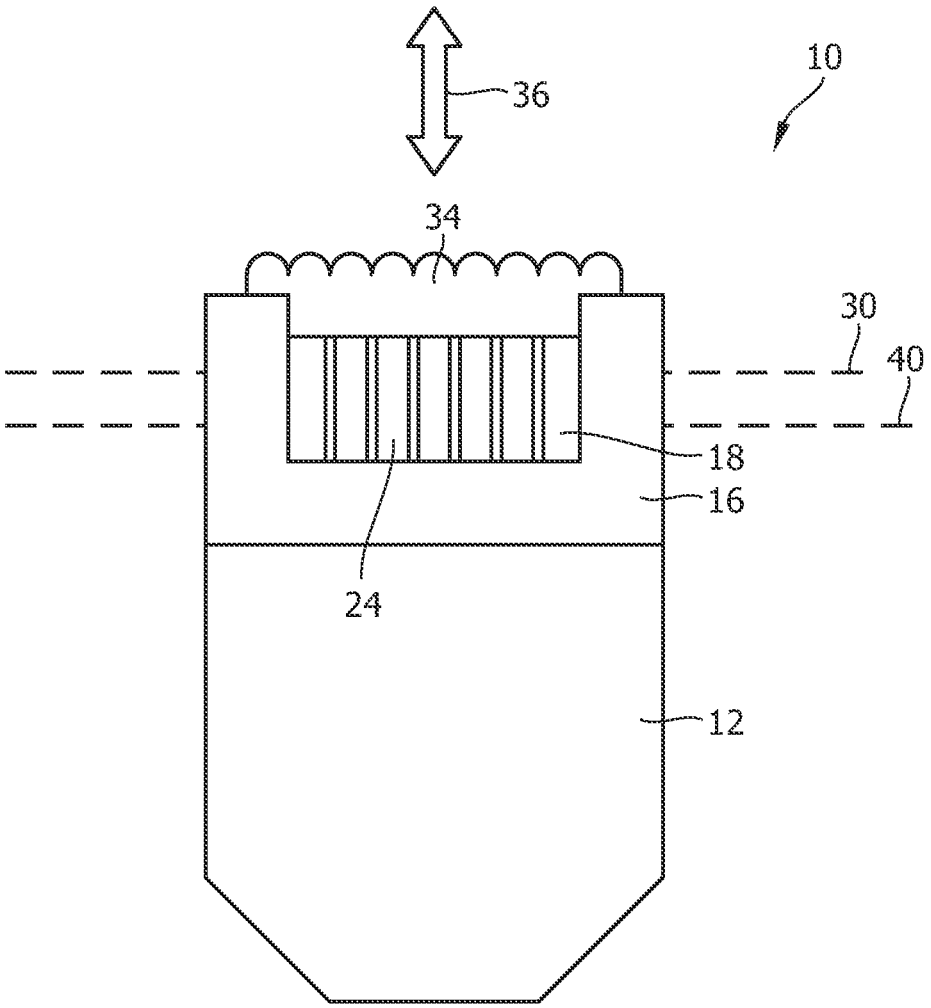
FIG. 2 is a simplified front view of the epilator shown in FIG. 1.

In FIG. 2 the epilator 10 discussed above with reference to FIG. 1 is represented, in a simplified manner, in an assembled state. The outer cap 16 is mounted to the housing 12, thereby covering the inner cap 14 (see FIG. 1) and defining a treatment window 24 through which the epilation head 18 may contact the skin when the epilator 10 is in an assembled state. The cylinder 26 and the eccentric member 32 are hidden behind the epilation head 18.

Figure 3:
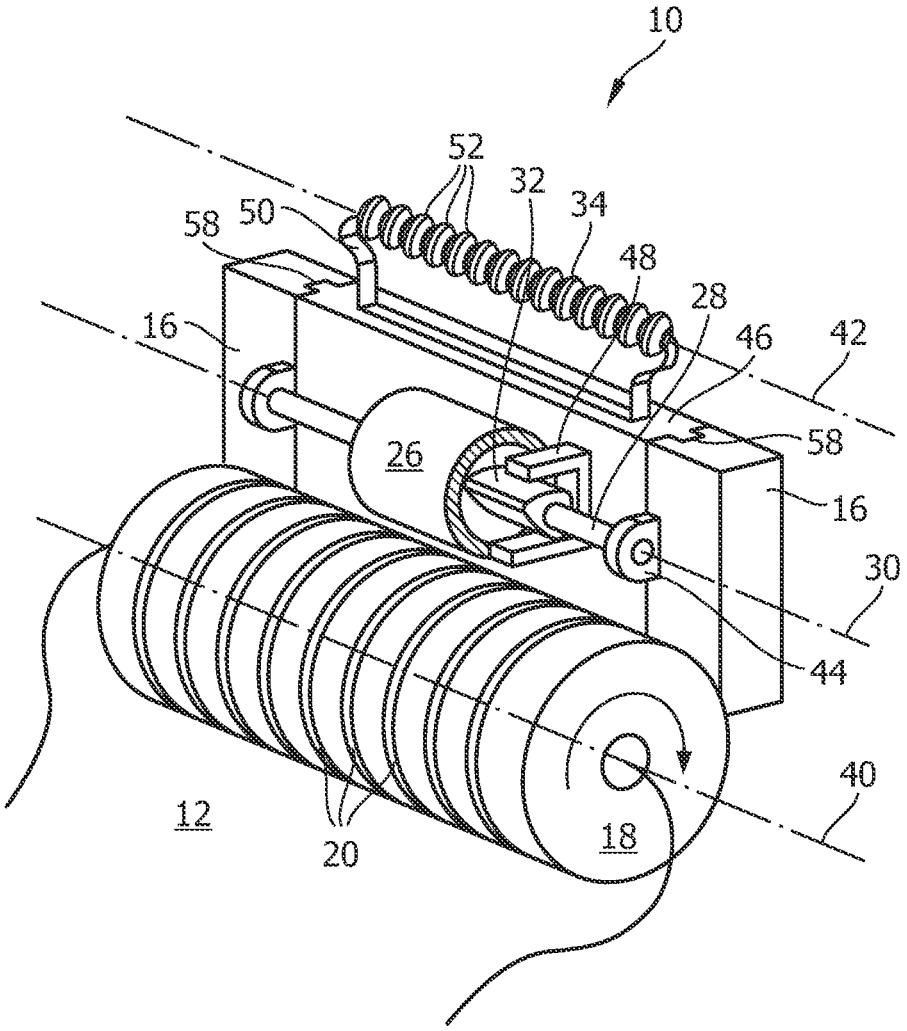
FIG. 3 shows a simplified oblique view of an epilator.

Referring to FIG. 3, there is shown, in a schematic and simplified manner, a portion of an epilator 10. The epilator 10 comprises an epilation head 18 having rotatable clamping discs 20, a massaging member 34 arranged next to the epilation head, and a cylinder 26 contacting the circumference of at least one of the clamping discs 20 for the purpose of being rotated by the clamping discs 20 about a rotational axis 30. The surface of the cylinder 26 is substantially symmetrical under rotation about the rotational axis 30. The epilator 10 further comprises an eccentric tappet 32 intended for being rotated by the cylinder 26. The cylinder 26 and the eccentric tappet 32 are rigidly coupled to each other. The epilator 10 further comprises a translational member 48 intended for being translated by the eccentric tappet 32, thereby translating the massaging member 34 relative to the epilation head 18. The epilator 10 further comprises a carrier 46 rigidly coupled to the translational member 48 and carrying the massaging member 34. The outer cap 16 has two vertical grooves 58 serving as rails for the carrier 46 on which the massaging member 34 is mounted. Thus, the carrier 46 is slidable relative to the outer cap 16. The cylinder 26 together with the eccentric member 32 is mounted to the outer cap 16 by means of an axle 28 supported by a bearing 34. As the epilation head 18 rotates about the rotational axis 40, friction between the epilation head 18 and the coupling cylinder 26 causes the coupling cylinder 26 to rotate about the rotational axis 30. The eccentric member 32, rotating along with the cylinder 26 about the common rotational axis 30 and contacting the translational member 48, moves the carrier 46 and hence the massaging member 34 in a substantially straight direction defined by the rail 58. The eccentric member 32, due to its eccentric transverse cross section with respect to the rotational axis 30, consequently converts the uniform rotational motion of the cylinder 26 into an up and down movement of the carrier 46 and thus of the massaging member 34. The effect of the massaging member 34 moving up and down is experienced by the user of the device 10 as a vibration on his or her skin. The massaging member 34 comprises a plurality of elementary massaging members 52 arranged in a row along a rotational axis 42 defined by the massaging member 34. In the specific embodiment illustrated here, the elementary massaging members 52 are spherical balls mounted to the carrier 46 by means of an axle (not shown) and a frame 50 having bearings for holding the axle.

Figure 4:
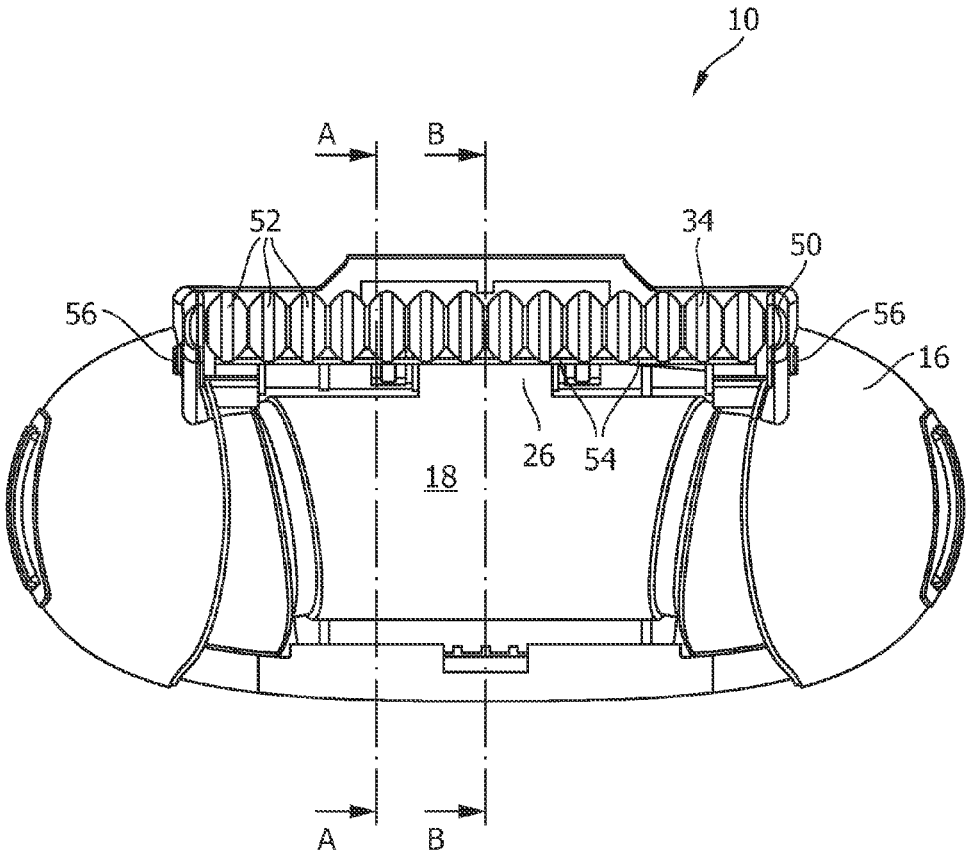
FIG. 4 shows a simplified top view of an epilator according to a specific embodiment.
Figure 5:
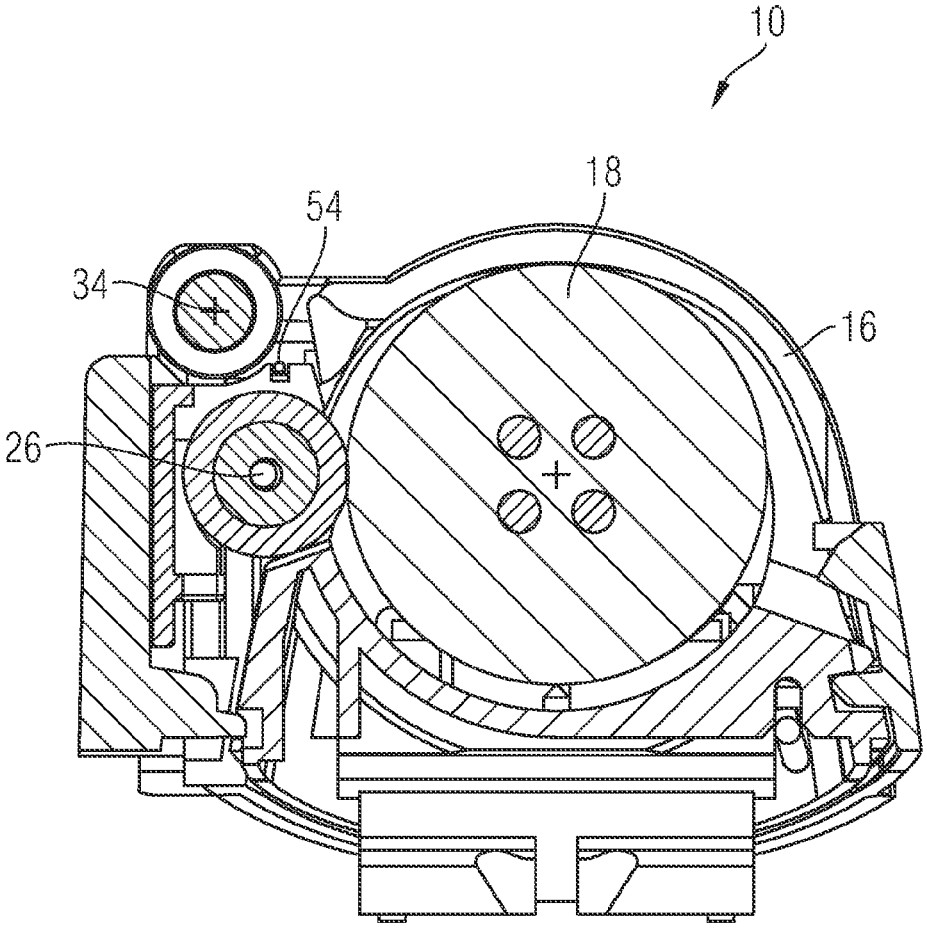
FIG. 5 shows a simplified cross sectional view of a portion of the epilator shown in FIG. 4, taken along a first plane.
Figure 6:
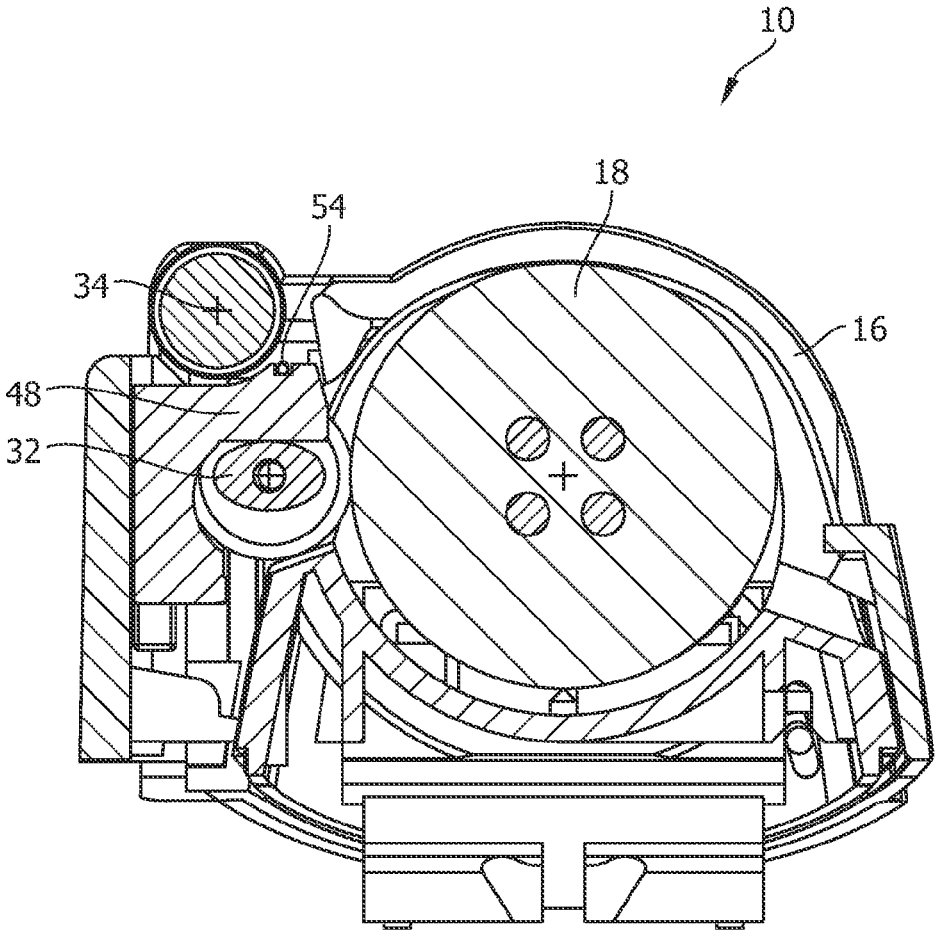
FIG. 6 shows a simplified cross sectional view of the epilator shown in FIGS. 4 and 5, taken along a second plane parallel to the first plane.
Figure 7:
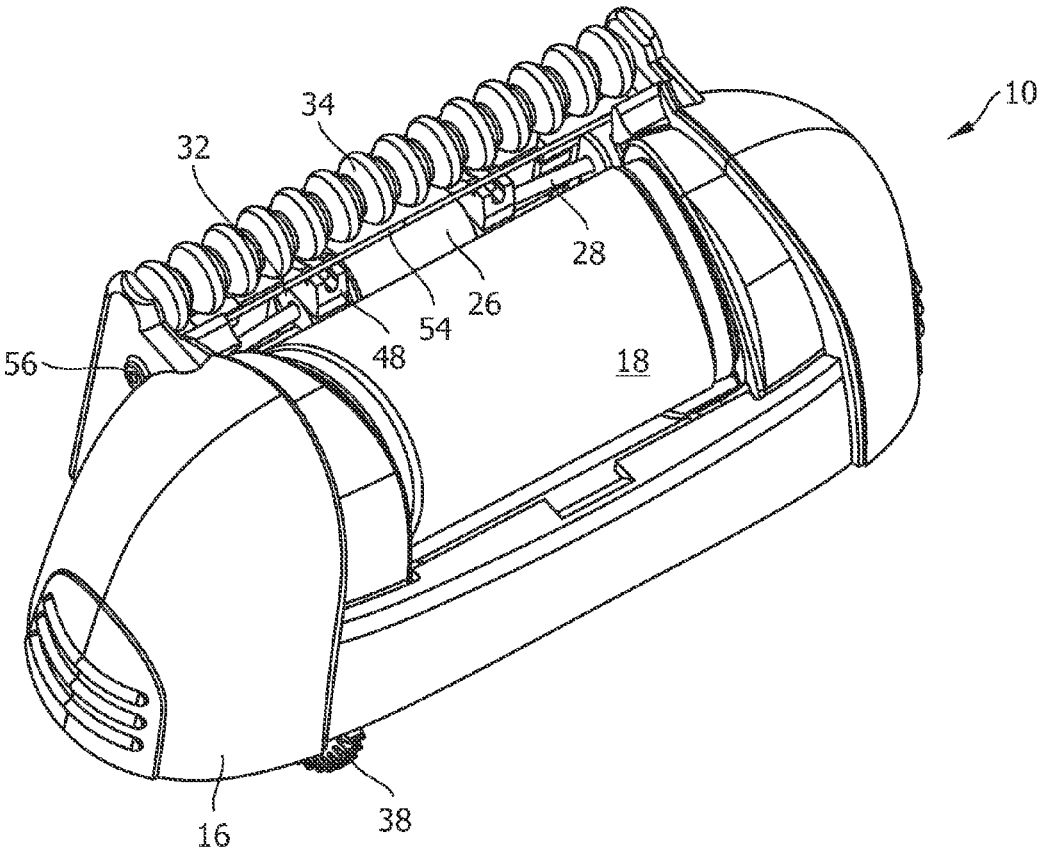
FIG. 7 shows a simplified oblique view of a portion of the epilator shown in FIGS. 4, 5, and 6.
Figure 8:
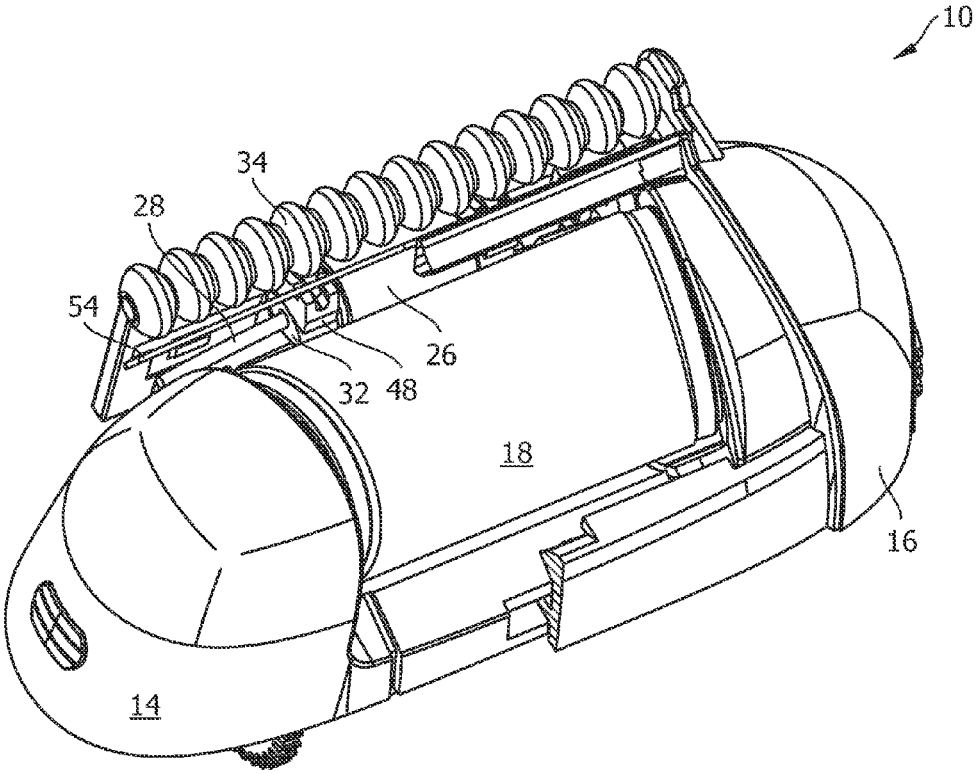
FIG. 8 shows a simplified cut-away oblique view of a portion of the epilator shown in FIGS. 4 to 7.

Referring now to FIGS. 4 to 8, there is illustrated in a simplified manner an epilator 10 according to a specific embodiment. The epilator 10 comprises an outer cap 16 partially surrounding an epilation head 18 having a plurality of clamping discs (not shown). Mounted to the outer cap 16 by means of a frame 50 is a massage roller 34 comprising a plurality of disc-shaped elementary massaging members 52 arranged in a row along the rotational axis of the roller 34. FIG. 5 illustrates a cross section of the epilator 10 along the line B-B in FIG. 4. The cylinder 26 contacts the circumference of a clamping disc 20 for receiving a force from the clamping disc when the clamping disc is rotated. The cylinder 26 has a non-slip surface provided, for example, by a rubber coating. FIG. 6 analogously illustrates the cross section of the epilator 10 along the line A-A in FIG. 4. The eccentric tappet 32 is asymmetrical under rotation about the rotational axis 30 of the cylinder 26. More specifically, the cross section of the eccentric tappet 32 perpendicular to the rotational axis 30 defines an ellipse. In the particular example shown here, the ratio of the ellipse's minor axis to the ellipse's major axis is in the range of 0.3 to 0.9. The eccentric tappet 32 contacts a translational member 48 mechanically coupled to the massaging member 34. As is best seen in FIGS. 4, 7, and 8, the epilator 10 comprises a spring 54 in the form of an elastic rod 54 running parallel to the rotational axis 30 of the cylinder 26. The spring 54, mounted to the outer cap 16 by means of two opposite bearings 56, biases the cylinder 26 toward the clamping discs 26, and the translational member 48 toward the cylinder 26. The outer cap 16 together with a driving mechanism 26, 32, 48, and the massage roller 34 form an attachment which is attachable to and detachable from the housing 12 of the epilator 10.

While the invention has been illustrated and described in detail in, respectively, the drawings and the foregoing description, the drawings and the description are to be considered exemplary and not restrictive. The invention is not limited to the disclosed embodiments. Equivalents, combinations, and modifications not described above may also be realized without departing from the scope of the invention.

The verb "to comprise" and its conjugations neither exclude the presence of other steps or elements nor the matter the verb "to comprise" refers to. The indefinite article "a" or "an" does not exclude a plurality. It is also noted that a single unit may provide the functions of several means mentioned in the claims. The mere fact that certain features are recited in mutually different dependent claims does not indicate that a combination of these features cannot be used to advantage. Any reference signs in the claims should not be construed as limiting the scope.

The invention claimed is:

1. An epilator comprising:

an epilation head having at least one rotatable disc-shaped member adjacent a treatment window, the at least one rotatable disc-shaped member for contacting a surface through the treatment window to perform epilation;

a massaging member arranged next to the epilation head;

a drive structure for driving the massaging member, said drive structure including a cylinder for contacting a circumference of said at least one rotatable disc-shaped member of the epilation head such that said at least one rotatable disc-shaped member of the epilation head rotates the cylinder of the drive structure about a rotational axis;

wherein the cylinder has a contact surface which is symmetrical about the rotational axis;

wherein an elastic rod or an elastic lead running parallel to the rotational axis of the cylinder biases the cylinder towards the at least one rotatable disc-shaped member;

wherein two opposite bearings mount both ends of the elastic rod or elastic leaf to the epilator; and wherein the elastic rod or the elastic leaf is substantially straight throughout an entire length of the elastic rod or the elastic leaf between the two opposite bearings and deformable in a direction perpendicular to the rotational axis.

2. The epilator as claimed in claim 1, wherein the drive structure further comprises an eccentric tappet arranged for being rotated by the cylinder.

3. The epilator as claimed in claim 2, wherein the cylinder and the eccentric tappet are rigidly coupled to each other.

4. The epilator as claimed in claim 2, wherein the drive structure further includes a translational member arranged for being translated by the eccentric tappet.

5. The epilator as claimed in claim 4, further comprising:

a carrier rigidly coupled to the translational member and carrying the massaging member.

6. The epilator as claimed in claim 5, further comprising:

a rail for guiding the carrier.

7. The epilator as claimed in claim 4, wherein the elastic rod or the elastic leaf biases the translational member towards the eccentric tappet.

8. The epilator as claimed in claim 1, wherein the contact surface of the cylinder is made of a slip-resistant material.

9. The epilator as claimed in claim 1, wherein the massaging member includes a massage roller.

10. The epilator as claimed in claim 1, wherein the massaging member and the drive structure including the cylinder are part of an attachment which is attachable to and detachable from a housing of the epilator.

11. The epilator as claimed in claim 10, wherein the attachment includes an outer cap surrounding a portion of the epilation head.

* * * * *